United States Patent [19]

Holcombe

[11] 4,379,381

[45] Apr. 12, 1983

[54] ROOF INSULATION SYSTEM

[75] Inventor: J. L. Holcombe, Dallas, Tex.

[73] Assignee: Emerson H. Mizell, Atlanta, Ga.

[21] Appl. No.: 156,606

[22] Filed: Jun. 5, 1980

[51] Int. Cl.[3] ..... E04B 2/28; E04B 2/60; E04F 21/00

[52] U.S. Cl. ..... 52/404

[58] Field of Search ..... 52/631, 404, 406, 407

[56] References Cited

U.S. PATENT DOCUMENTS

| | | | |
|---|---|---|---|
| 3,206,805 | 9/1965 | Steenhagen | 52/408 |
| 3,662,509 | 5/1972 | Studzinski | 52/404 |
| 3,797,180 | 3/1974 | Grange | 52/630 |
| 4,147,003 | 4/1979 | Alderman | 52/404 |
| 4,151,687 | 5/1979 | Kephart | 52/631 |
| 4,303,713 | 12/1981 | Clemensen | 52/404 |

FOREIGN PATENT DOCUMENTS

| | | | |
|---|---|---|---|
| 2315793 | 10/1974 | Fed. Rep. of Germany | 52/407 |
| 2407308 | 10/1977 | France | 52/408 |
| 672297 | 5/1952 | United Kingdom | 52/407 |

*Primary Examiner*—John E. Murtagh

*Attorney, Agent, or Firm*—Shlesinger, Arkwright, Garvey & Dinsmore

[57] ABSTRACT

An insulation system for a roof structure which includes a semi-rigid insulation blanket overlying a support structure across roof purlins and having additional insulation material filling a U-shaped trough created by the blanket between adjacent purlins. The semi-rigid insulation blanket is notched by the manufacturer at predetermined points to enable the blanket to easily and securely fold over and around the support structure and roof purlins.

7 Claims, 16 Drawing Figures

18
21
22
24
25

ROOF INSULATION SYSTEM

BACKGROUND AND FIELD OF INVENTION

The present invention pertains to a method and structure for insulating the roofs of buildings which are under construction and roofs of buildings which have been completely constructed.

Presently, a common method for insulating a roof structure consists of laying insulation mats or blankets between and along the length of the roof or joists or purlins. At the time of insulation, the insulation blankets are generally unrolled into place and cut to size to fit between adjacent joists. One problem resulting from this method of insulation is the considerable waste of insulating material when the individual insulation blankets are cut to fit between roof joists which may be spaced at varying distances. Another common problem is that laying the insulation between roof joists often creates incomplete seals at the joists thereby reducing the efficiency of the insulating system. Several improvements have been made on the common method including U.S. Pat. No. 4,147,003 to Alderman and U.S. Pat. No. 4,014,150 to Wells. However, none of the prior art inventions provide a sufficient answer to the need for a more efficient method of installing insulation material in a roof structure.

OBJECTS AND SUMMARY

Accordingly, it is one object of the present invention to provide an insulation system which will reduce the amount of insulating material which is wasted during installation.

Another object of the present invention is to provide an insulation system which will include laying insulating blankets across roof purlins thereby reducing waste and increasing insulating efficiency.

A further object of the present invention is to provide an insulation system which includes an insulation blanket which is notched at predetermined distances to better lie across roof purlins.

A still further object of the present invention is to provide an insulation system which includes a support system for an insulation blanket which will lie across roof purlins.

Another object of the present invention is to provide an insulation system which provides a means for insulating an already assembled roof structure.

Still another object of the present invention is to provide an insulation system wherein trough area created by laying an insulation blanket is filled with additional insulating material.

A further object of the present invention is to provide an insulation system wherein a dead air space provides the insulating medium.

A still further object of the present invention is to provide an insulation system wherein the installation requires the width cutting of only one of a series of insulation blankets.

Another object of the present invention is to provide an insulation system wherein each individual insulation blanket lays over the projecting vapor barrier backing of an adjacent insulation blanket whereby heat loss between blankets is effectively eliminated.

A further object of the present invention is to provide an insulation system wherein an additional insulation block is placed above the roof joists between overlying insulation blanket and attached roof panel to compensate for the compression of the insulation blanket at these points.

These and further objects of the present invention are accomplished by an insulation system which includes a semi-rigid insulation blanket overlying a support structure and across roof purlins and having insulation material filling a U-shaped trough created by the blanket between adjacent roof purlins. The semi-rigid insulation blanket is notched by the manufacturer at predetermined points to give the blanket a hinge-like flexibility to enable the blanket to easily and securely fold over and around the support structure and roof purlins.

DESCRIPTION OF THE INVENTION

Figure 1:
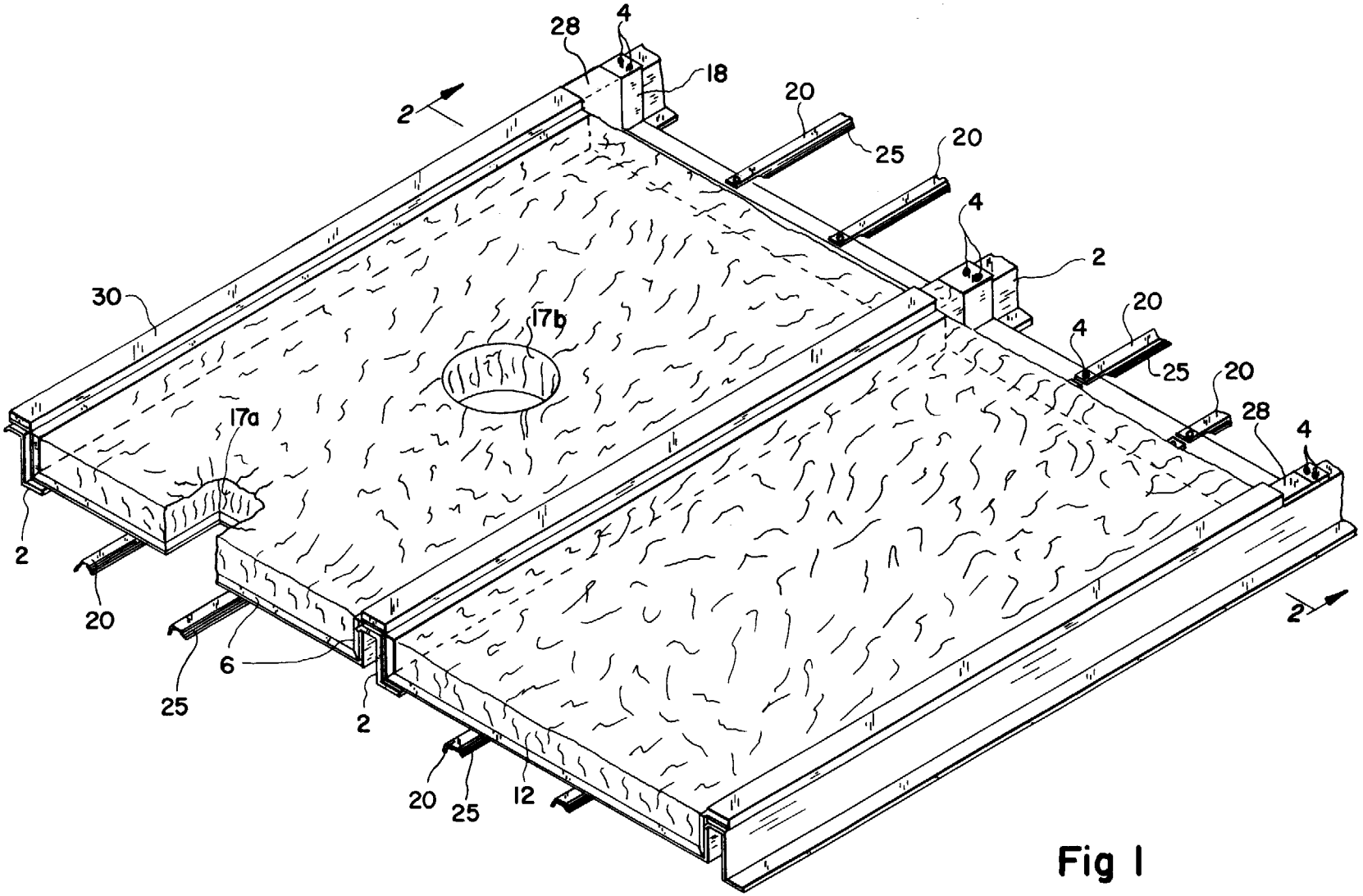
FIG. 1 is an isometric view of the insulation system of the present invention.
Figure 2:
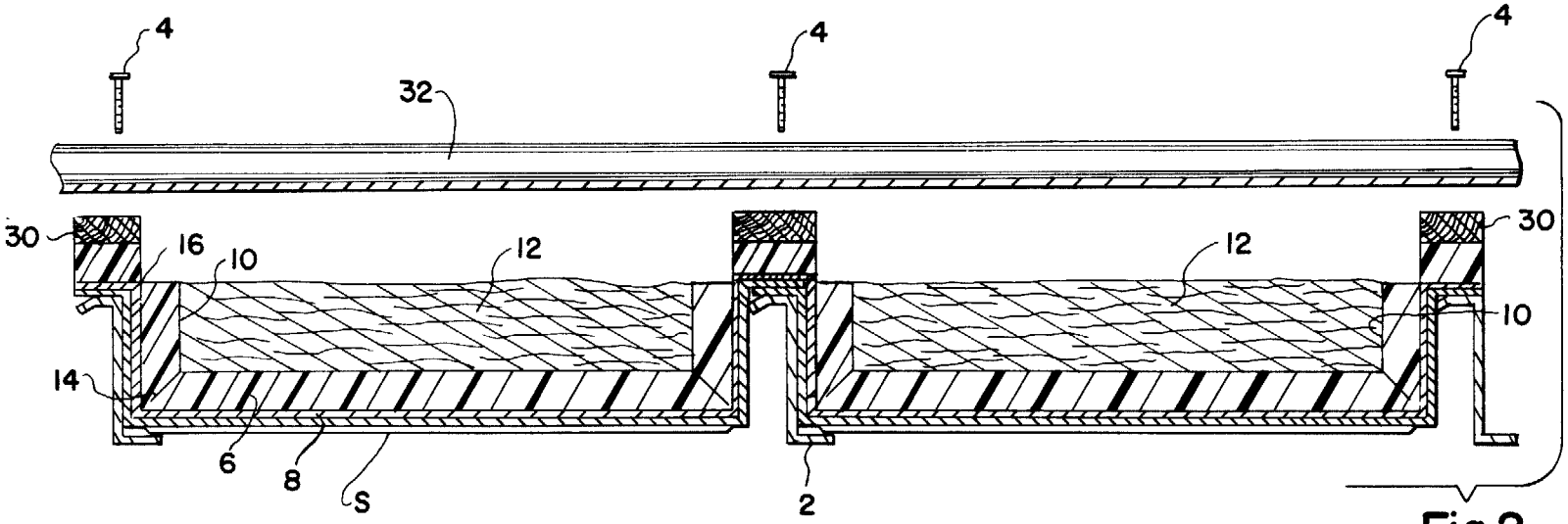
FIG. 2 is a cross sectional view of the insulation system taken along the line 2—2 and viewed in the direction of the arrows.

Referring to FIGS. 1 and 2, the insulation system includes a support structure S which is attached to the roof purlins or joists 2 by means of plastic fasteners 4 or similar snap-in type fasteners. Overlying the support structure S is a semi-rigid insulation blanket 6 having a vapor barrier backing 8 of metal foil, plastic, etc. and forming a generally U-shaped trough area 10 which is filled with an insulation batt. 12. The insulation system of the present invention is primarily designed to be installed in a roof during construction of a building and prior to placement of a roof panel.

The initial step in preparation for installing the insulation system involves preparing a blueprint of the roof support structure showing all of the roof joists or purlins. The blueprint is drawn to show the distances between each purlin in the roof structure and between purlins and any obstructions which might interfere with the installation of an insulation blanket. The blueprint is then submitted to the insulation manufacturer where the roof design blueprint data is fed into a computer which controls the machine for cutting the insulation blanket 6. Insulation blanket 6 is a blanket of fiber glass, polyurethane or similar insulating material and is semi-rigid having a density in the range of about 1 to about 3 pounds per cubic foot and preferably 1 to 1½ pounds per cubic foot. The blanket may vary in thickness but, for maximum flexibility combined with optimum insulating properties, it is preferably about 1 to about 1½ inches thick with a thin paper, foil or other appropriate thin vapor barrier backing. The cutting machine will cut the blanket 6 at the proper length but, more importantly, as programmed by the roof design blueprint data, the cutting machine will notch the blanket at the proper positions to give the blanket a hinge-like flexibility needed for lying over the roof purlins 2 and support structure S.

Figure 3A:
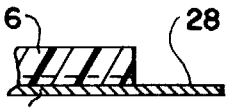
FIG. 3*a* is a fragmentary cross-sectional view taken along the line 3*a*—3*a* of FIG. 3 and viewed in the direction of the arrows.
Figure 3:
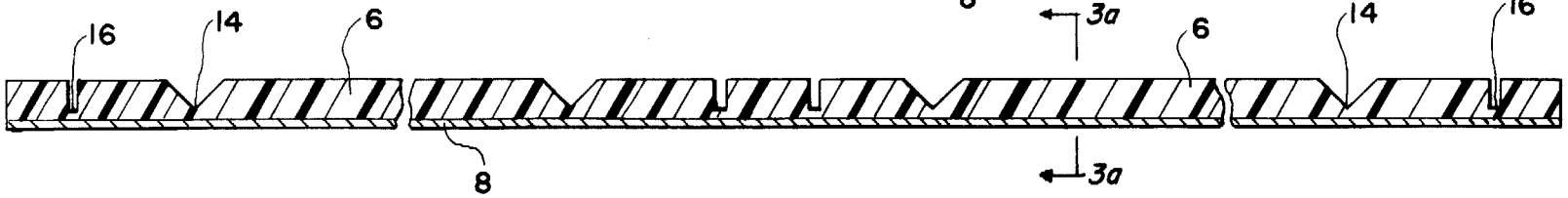
FIG. 3 is a cross-sectional view of the semi-rigid insulation blanket of the present invention.

As best shown in FIG. 3, the semi-rigid insulation blanket 6 is cut with both grooves 14 and slots 16 at the distances specified by the roof design blueprint. The grooves 14 are approximately V-shaped in cross-section and allow the blanket 6 to fold in towards itself at the base of the support structure S to form the trough areas 10. Slots 16 are generally rectangular in cross section and give the blanket 6 hinge-like flexibility for folding over and around the purlins 2 and support structure S (see FIG. 2). Both grooves 14 in slots 16 are cut into the top surface of the blanket 6 to within about ⅛ inch of the vapor barrier 8. The remaining ⅛ inch of semi-rigid material provides sufficient strength to the blanket to insure that it is not torn or cut at any of the notched areas during use and insures that the vapor barrier 8 is not accidently cut during the notching process. Cutouts 17*a* and 17*b*, as illustrated in FIG. 1, are typical for use with different obstacles or obstructions.

Previous insulation systems which draped or laid insulation blankets over roof purlins encountered problems with sagging of the insulation between roof purlins. The present invention eliminates this problem by providing the support structure S which furthermore creates trough areas 10 which are uniformly rectangular in dimension. In the past each insulation bat between purlins 2 would have to be individually cut to the dimension of a space between adjacent roof purlins. This procedure results in significant wasted insulation as a certain amount of insulation is cut from the width of each blanket. With the existing art, insulation is cut from the width of each blanket. With the present invention however, insulation bats 12 of uniform size may be simply rolled into trough areas 10 which are now all of the same size. This procedure eliminates almost all of the waste produced by the previous methods and is simpler to install because of the programmed cutting of the insulation blankets 6 at the manufacturing plant. Furthermore, the insulation blanket 6 may also be cut according to programmed distances to accomodate any obstructions which may be encountered in the roof support structure such as vents, pipes or the like.

Figure 4:
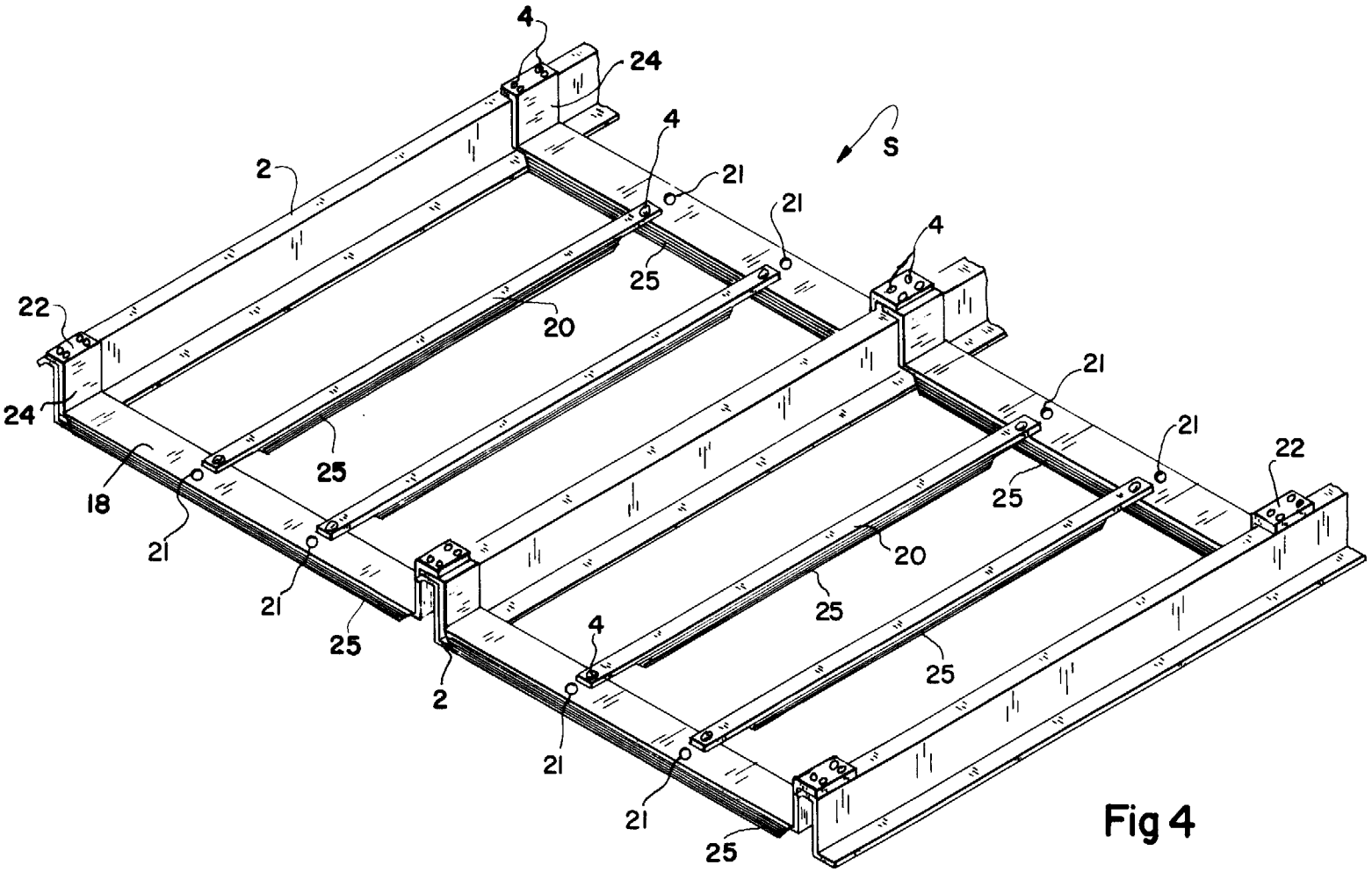
FIG. 4 is an isometric view of the support structure of the present invention.
Figure 15:
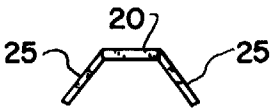
FIG. 15 is an end view of the modified form described in FIG. 12.

Once the semi-rigid insulation blanket 6 is properly cut and notched, a roll is made of the blanket and is delivered to the building where it is to be used. The roof structure of the building is adapted for receiving the insulation blanket 6 by constructing a support system S within the roof purlins 2. As shown in FIG. 4, support system S includes main support brackets 18 transverse to purlins 2 and attached to the purlins by means of plastic snap-in fastners 4 and longitudinal support brackets 20. Brackets 18 and 20 include fastening holes 21 for fasteners 4. Brackets 18 have two sets of holes for overlap fastening which allow for adjustment for purlins 2 of various widths allowing up to several inches difference. Main brackets 18 as best shown in FIGS. 8 to 11 are preferably 6 inches in width and may be of variable length made from coil stock metal. Main brackets 18 contain an attaching plate 22 and vertical portion 24 which causes the base of the bracket to hang down approximately 4 to 8 inches from the plate 22 thereby forming the trough area 10. Longitudinal brackets 20 as best shown in FIGS. 12 to 15 are similarly prepared from coil stock metal and are about one inch in width. Both Brackets 18 and 20 have downwardly projecting flanges 25 on both sides and running substantially the length of the bracket as best shown in FIG. 15. The downwardly projecting flanges 25 allow numerous brackets to be stacked one upon the other.

Once support brackets 18 and 20 are positioned between purlins 2, the first roll of semi-rigid insulation blanket 6 is positioned across the roof purlins 2. As best shown in FIG. 2, the blanket 6 is placed so that slots 16 provide the blanket with hinge-like flexibility to fold around the top corners of the purlins 2 and the corner of the main brackets 18 where the attaching plate 22 and vertical portion 24 meet. Grooves 14 are positioned at the lower corner of the vertical portion 24 causing the blanket 6 to fold back on itself and create a generally rectangular trough area 10. With the support brackets 18 and 20 beneath, the blanket 6 of the present invention will not sag in between purlins as occurs with prior art insulation methods.

Furthermore, the first roll of insulation 6 is placed at one end of the roof structure with the projecting vapor barrier overlap 28 facing towards the middle of the roof and lying approximately ⅜ of the way across the main bracket 18 (see FIG. 1) of a distance as desired. Each insulation blanket 6 is manufactured with a vapor barrier overlap 28 running the length of the blanket on one side projecting about two inches from the insulating material. As the second insulation blanket and subsequent blankets are positioned side by side in the insulation system, adjacent blankets are placed with the side of the second blanket not having a vapor barrier overlap overlying the vapor barrier overlap of the first blanket. This overlapping of insulation blankets using vapor barrier overlaps 28 creates a seal between adjacent blankets effectively eliminating the heat loss which is generally encountered between adjacent insulation blankets.

After the insulation blankets 6 have been positioned forming the trough areas 10, increased insulating effectiveness is achieved by filling the troughs 10 with insulation batting 12 of fiber glass or similar insulating material. The batting 12 may be comprised of rolls of insulating material which can be easily rolled into the trough areas 10 without additional size cutting because the trough areas 10 are of uniform rectangular sizes. Instead of rolls of batting material 12, the trough areas 10 may be filled with blown insulating material. Whichever type of insulating filler material is used, the trough areas 10 should most preferably be filled to about the height of the trough area or, in other words, to the point where the insulation blanket 6 is cut at the slots 16 (see FIG. 2).

Figure 6:
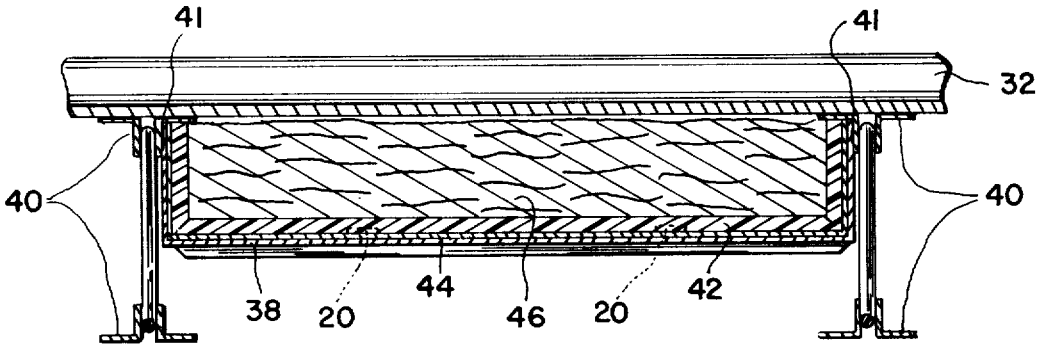
FIG. 6 is a cross-sectional view of a modified form of the present invention attached to an already existing roof structure.

Finally, a thermal block 30 is placed along the length of the purlins 2 overlying the blanket 6 (see FIGS. 1, 2 and 6). Thermal blocks 30 are made of wood, or similar rigid material and is placed on top of the blanket along the length of the purlins 2 where a roof panel 32 will subsequently be secured. Without the presence of a thermal block 30, attaching a roof panel would compress the blanket 6 thereby reducing the insulating ability of the system adjacent to the purlins 2. However, it has been found that a thermal block of about one inch in thickness positioned between the roof panel 32 and the insulation blankets 6 will decrease the heat loss at the purlins 2 by as much as 17% to 25%.

FIG. 5

Figure 5:
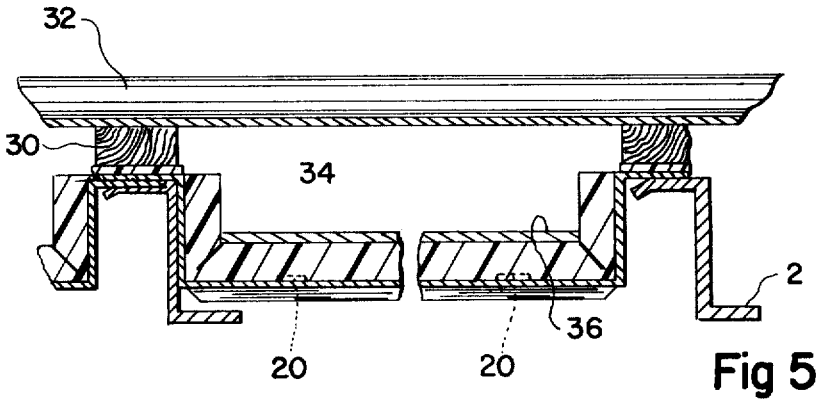
FIG. 5 is a cross-sectional view of a modified form of the insulation system of the present invention using a dead air space as an insulating means.

Instead of placing an insulation bat 12 within the trough 10, the present invention also encompasses the use of a dead air space 34 for insulation purposes. FIG. 5 shows such a construction wherein the trough area 10 is designed to be from 2 to 3 inches in height between the top surface of the blanket 6 and the roof panel 32. The height of the trough 10 is particularly important because it has been found that a smaller space will not provide sufficient insulation and a larger space will allow the formation of convection-like air currents within the air space 34. These convection-like air currents will magnify heat loss at the outer boundaries of the air space 34 and greatly decrease the insulating efficiency of the dead air space construction. However, it has been found that a trough area of 2 to 3 inches in height will be substantially free of air currents and will provide an inexpensive insulating means. A reflector sheet 36 is preferably placed at the bottom of the dead air space 34 to further reduce any possible heat loss.

Figure 7:
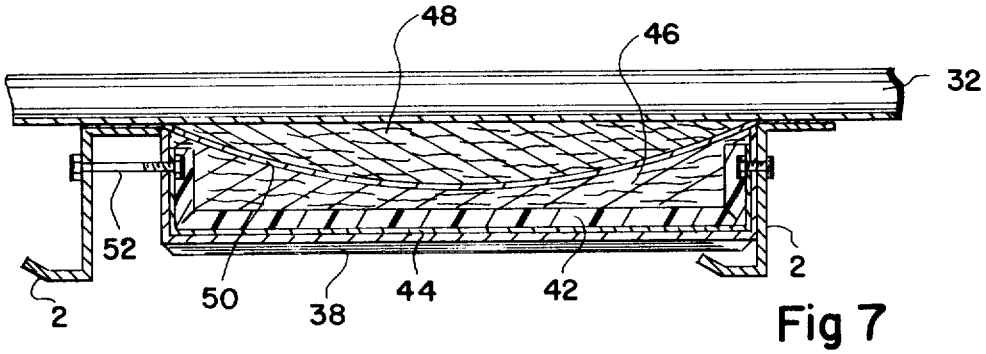
FIG. 7 is a cross-sectional view of a modified form of the present invention attached to an already existing roof structure and insulating means.
Figures 8, 9, 10, 11:
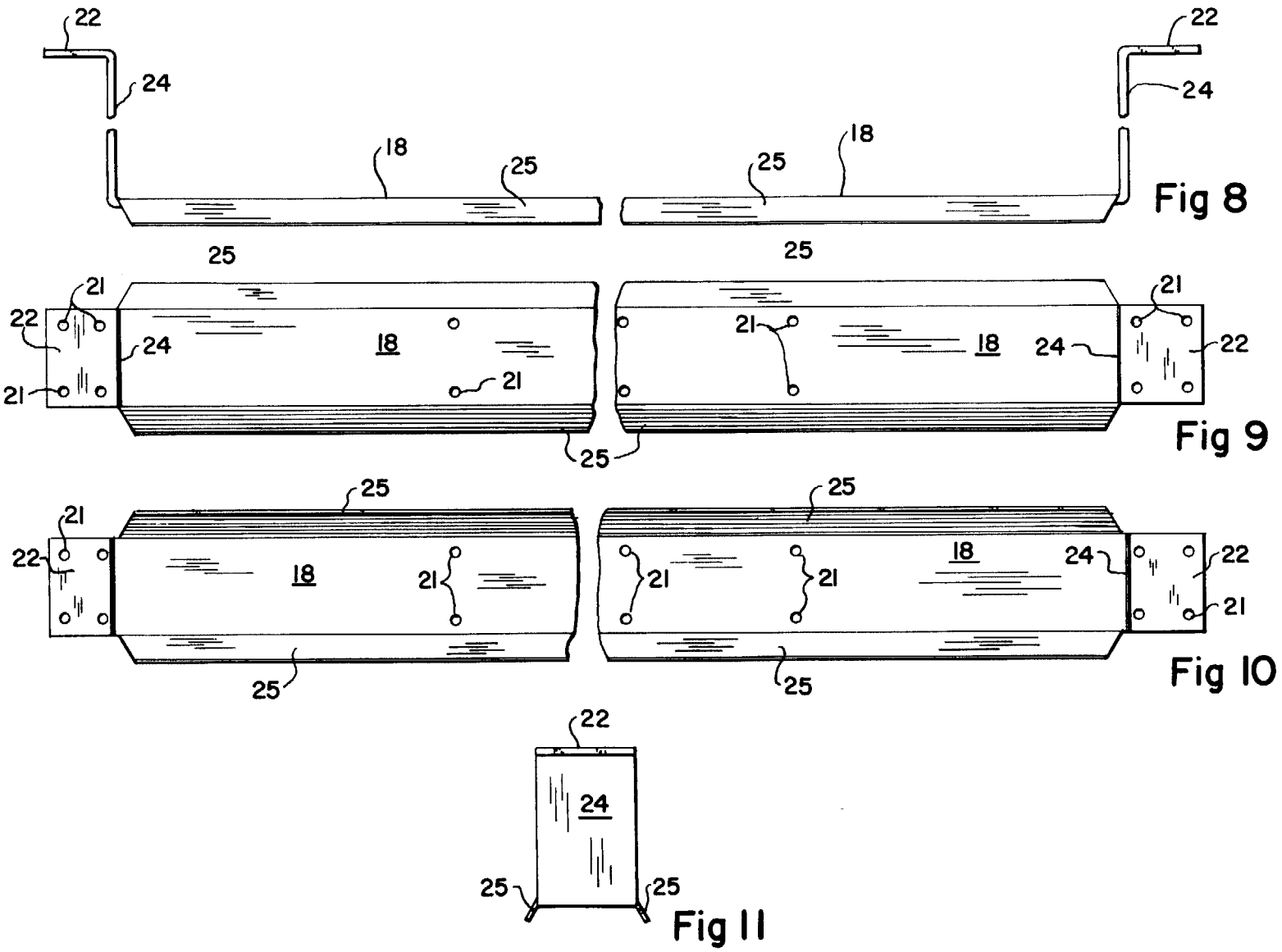
FIG. 8 is a side elevational view of a support bracket showing my new design.
FIG. 9 is a top plan view thereof.
FIG. 10 is a bottom plan view thereof.
FIG. 11 is an end view of the support bracket described in FIG. 8.
Figure 12:
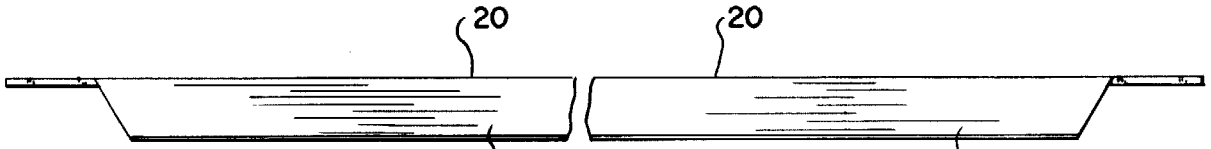
FIG. 12 is a side elevational view of a modified form of the support bracked described in FIG. 8.
Figure 13:
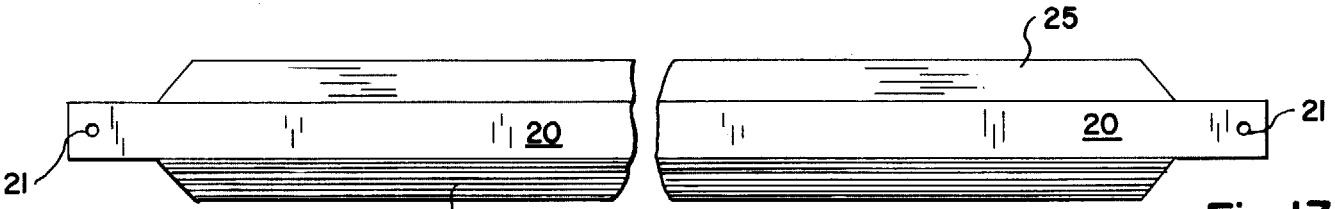
FIG. 13 is a top plan view of the modified form described in FIG. 12.
Figure 14:
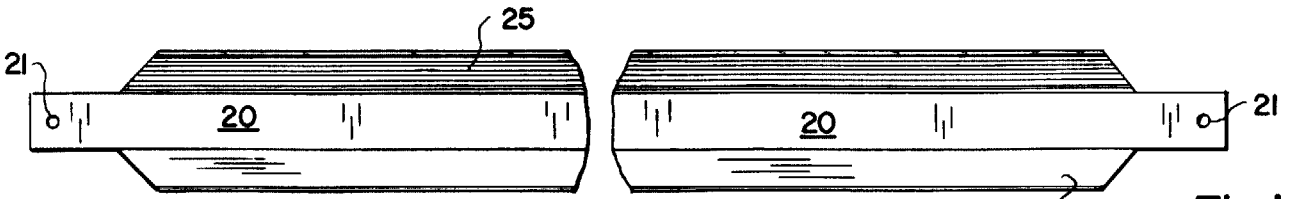
FIG. 14 is a bottom plan view of the modified form described in FIG. 12.

FIGS. 6 and 7

A further aspect of the present invention is to provide an insulation system that can be retrofitted into an already constructed building. Such a system is shown in FIGS. 6 and 7 where FIG. 6 shows the installation of the present invention into a roof having no previous insulation and FIG. 7 shows the installation of the present invention into a roof structure having some previously existing insulating material. In both instances, FIGS. 6 and 7, a support pan 38 is positioned between the roof purlins or joists for supporting the insulation system. Various means could be used for securing the support pans 38 but for exemplary purposes, FIG. 6 shows a support pan attached to bar joists 40 by means of a weld 41 or other securing means and FIG. 7 shows a support pan 38 attached to roof purlins 2. In FIG. 6, a support pan 38 is welded between bar joists 40 and supports the insulation trough 42 with a vapor barrier 44 which is positioned by sliding the trough along the support pan 38. Insulation trough 42 is a generally U-shaped section of semi-rigid insulation material preferably made of the same material as the insulation blanket 6 described above. After a series of support pans 38 and fiber glass troughs 42 are in position, insulating material 46 (such as fiber glass) is blown into the troughs 42. In FIG. 7, an insulation system according to the present invention is added to already existing insulation 48. Vapor barrier 50 of the existing insulation 48 is first perforated in numerous spots to prevent condensation. Once the existing vapor barrier 50 has been perforated, the installation of the insulation system is the same as that for a building without previous insulation, except that support pan 38 is secured to purlins 2 by means of bolts 52.

Another modification of the present invention consists of constructing the insulation blanket 6 of high density fiber glass or similar material. By constructing the insulation blanket 6 with a density of greater than 3 pounds per cubic foot the blanket 6 could support itself between roof purlins and there would be no need for an additional support structure S.

An obvious alternative construction of the insulation blanket 6 would be one in which the grooves 14 and slots 16 would be cut into the blanket along the longitudinal running axis of the blanket 6 rather than transverse to the longitudinal axis so that the blanket 6 may be run parallel to and between and over the purlins 2.

While this invention has been described as having a preferred design, it will be understood that it is capable of further modification. This application, is therefore intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. An insulation system comprising:

(a) spaced roof joists having length and side and top surfaces;

(b) support structures located between and supported by said roof joists;

(c) a semi-rigid insulation blanket overlying said support structures and said roof joists;

(d) said semi-rigid insulation blanket having front, back and side surfaces and length and width;

(e) said semi-rigid insulation blanket having a vapor barrier on said back surface and between said support structure and said insulation blanket;

(f) said semi-rigid insulation blanket having a series of predetermined recesses cut into said front surface;

(g) said predetermined recesses providing hinges for laying said insulating blanket over said support structure and roof joists;

(h) approximately U-shaped trough areas formed by said insulation blanket between some of said predetermined recesses;

(i) a series of said blankets in side-by-side relationship with the widths of said blankets running approximately parallel to the lengths of said roof joists;

(j) insulation material contained within and generally filling said trough areas;

(k) said support structure including main support brackets and longitudinal support brackets;

(l) said main support brackets being generally U-shaped and having base, side and flange portions;

(m) said base of said support bracket being positioned between and transverse to said roof purlins;

(n) said side portions extending vertically upward from said base of said support bracket;

(o) said flange portions being attached to the upper end of said sides and being connected to said roof purlins;

(p) said base of said main support bracket having length, two sides and a downwardly projecting stacking flange on both sides and running the length of said base;

(q) said longitudinal support brackets being of one continuous piece and having length, two sides and two edges;

(r) said two ends of said longitudinal support bracket having connecting means;

(s) said longitudinal support brackets having downwardly projecting stacking flanges on both sides and running almost the length of said longitudinal support bracket; and, (t) said longitudinal support brackets being connected to said base of said main support brackets and being generally parallel to the length of said roof joists.

2. An insulation system as in claim 1 and wherein:

(a) said main support brackets being about six inches in width from side to side.

3. An insulation system as in claim 1 and wherein:

(a) said longitudinal support bracket being about one inch in width from side to side.

4. An insulation system as in claim 1 and wherein:

(a) said two sides of said main support bracket being approximately 4 to about 8 inches in height from said base to said flange portions.

5. An insulation system as in claim 1 and wherein:

(a) said flange portion being approximately 3 and ½ inches in length from said side of said main support bracket.

6. An insulation system as in claim 1 and wherein:

(a) said downwardly projecting flanges on said main and said longitudinal support brackets project downwardly approximately 1 inch.

7. An insulation system comprising:

(a) spaced roof joists having length and side and top surfaces;

(b) support structures located between and supported by said roof joists;

(c) a semi-rigid insulation blanket overlying said support structures and said roof joists;

(d) said semi-rigid insulation blanket having front, back and side surfaces and length and width;

(e) said semi-rigid insulation blanket having a vapor barrier on said back surface and between said support structure and said insulation blanket;

(f) said semi-rigid blanket having a series of predetermined recesses cut into said front surface;

(g) said predetermined recesses providing a plurality of sets of hinges for laying said insulation blanket as a unitary sheet oversets support structures and providing one set for each of at least three roof joists;

(h) approximately U-shaped trough areas formed by said insulation blanket between some of said predetermined recesses;

(i) a series of said blankets in side-by-side relationship with the widths of said blankets running approximately parallel to the length of said roof joists;

(j) insulation material contained within and generally filling said trough areas;

(k) said support structure including a main support bracket having a base, two sides and two flange portions;

(l) said base of said main support bracket being positioned between and transversed to two roof purlins;

(m) said side of said support structure extending vertically upward from said base; and, (n) flange portions being attached to the upper end of said sides and being attached to adjacent roof purlins.

* * * * *